US005595037A

United States Patent [19]

Paques

[11] Patent Number: 5,595,037

[45] Date of Patent: Jan. 21, 1997

[54] METHOD OF BUILDING UP A SILO OR TANK WITH A LINING, AND A WALL SHEET FOR BUILDING UP A SILO OR TANK AND METHOD OF MANUFACTURING SUCH WALL SHEET

[75] Inventor: Gerardus H. F. Paques, Balk, Netherlands

[73] Assignee: Industrial Tankbuilders B.V., Joure, Netherlands

[21] Appl. No.: 283,902

[22] Filed: Aug. 4, 1994

[30] Foreign Application Priority Data

Aug. 6, 1993 [NL] Netherlands ..... 9301376

[51] Int. Cl.[6] ..... E04B 2/18

[52] U.S. Cl. ..... 52/591.5; 52/796.1; 52/591.4; 52/192; 52/247; 52/249

[58] Field of Search ..... 52/591.4, 591.5, 52/796.1, 591.1, 247, 249, 192, 521, 540

[56] References Cited

U.S. PATENT DOCUMENTS

| | | | |
|---|---|---|---|
| 2,235,937 | 3/1941 | Linberg . | |
| 2,729,313 | 1/1956 | Ernestus . | |
| 3,133,677 | 5/1964 | Bertels et al. . | |
| 3,632,465 | 1/1972 | Hardingham | 52/249 X |
| 4,162,597 | 7/1979 | Kelly | 52/591.5 |
| 4,188,759 | 2/1980 | Liet et al. . | |
| 4,602,463 | 7/1986 | Holowotyj | 52/247 X |
| 4,625,478 | 12/1986 | Goode | 52/249 X |
| 4,878,258 | 11/1989 | Casey | 52/591.5 X |

FOREIGN PATENT DOCUMENTS 2207946 2/1989 United Kingdom .

*Primary Examiner*—Carl D. Friedman
*Assistant Examiner*—W. Glenn Edwards
*Attorney, Agent, or Firm*—Keck, Mahin & Cate

[57] ABSTRACT

A method of and wall sheet for building up a silo with lining and a method of manufacturing wall sheets for such a silo. The wall sheets are pre-formed wall sheets, comprising a base sheet and a sheet of lining material, bonded thereto in a slightly staggered manner. The lining material covers a number of bolt holes of the base sheet and already fitted in the covered bolt holes are fastening means, secured against rotation and also covered by the lining material. After the wall sheet has been mounted, free edge strips of the layer of lining material fall over uncovered edge zones of adjacent wall sheets. Connecting sheets of lining material are welded together along the edges, and, if necessary, the overlapping strips are bonded to the subjacent wall sheets.

25 Claims, 5 Drawing Sheets

METHOD OF BUILDING UP A SILO OR TANK WITH A LINING, AND A WALL SHEET FOR BUILDING UP A SILO OR TANK AND METHOD OF MANUFACTURING SUCH WALL SHEET

FIELD OF THE INVENTION

The invention relates to a method of building up a silo or tank with a lining by means of pre-formed wall sheets connected to each other by means of screw connections for forming a complete silo wall. The invention further relates to a wall sheet for building up a silo and to a method of manufacturing such wall sheet.

BACKGROUND OF THE INVENTION

For storing industrial and agrarian products, such as for instance manure, it is already known to build up silos of preformed sheets provided with bolt holes, screwed together with slight overlap to form a normally round silo wall, which is built up on a priorly arranged bottom or supporting edge and which may later be provided with a suitable roof, if desired. Such silos may for instance be built up of stainless-steel wall sheets or zinc-coated sheets or enamelled wall sheets or the like. Normally, the pre-formed wall sheets are substantially rectangular and are provided, in the edge areas thereof, with a plurality of holes for bolts or the like, by means of which the wall sheets can be attached to each other with an overlap, with the interposition of a suitable sealing material.

If a thus constructed silo is intended for storage of aggressive substances, it is often necessary to provide a special lining of a material resistant to the substances in question, because the sealing material and/or the material of the wall sheets employed is (are) not resistant to the substances to be stored in the silo.

According to present-day practice, such lining is provided on the inside of a silo after the silo wall has been built up entirely. As a consequence, the advantages of a silo to be built up of factory-finished, ready-made wall sheets are partly lost again. Providing a wall covering on the sometimes very extensive inner wall of a silo is troublesome and time-consuming and moreover requires specific equipment which should often be specially transported to the building site. If, prior to applying the lining, the silo wall should be roughened mechanically and/or pretreated chemically, for instance through sandblasting, (steel) grit blasting or the like, an oxide layer may be formed on a portion of the wall in the time which is required for treating the entire silo wall, which oxide layer prevents an optimum bond. Further, the weather at the building site may cause problems. Comparable problems may occur if a bonding agent is to be applied.

SUMMARY OF THE INVENTION

The object of the invention is to overcome the above-outlined drawbacks. To this end, according to the invention, a method of the above-described type is characterized in that wall sheets are used provided, along the edges thereof, with bolt holes, the bolt holes in zones located along at least two connecting edges being provided with fastening members secured at least against rotation, and the zones comprising these fastening members and the rest of each wall sheet being covered, on the inside thereof, by a layer of lining material bonded to the wall sheet, leaving free two other free edge zones provided with bolt holes, which layer of lining material extends by edge strips beyond the edges of the zones having bolt holes provided with fastening members, and that the wall sheets are fastened to each other by means of the fastening members and the bolt holes in a manner such that these edge strips of the layer of lining material of a wall sheet cover the free edge zones of two adjacent wall sheets, and that the adjacent edges of the layers of lining material of different wall sheets are welded together.

BRIEF DESCRIPTION OF THE DRAWINGS

The invention will be further explained hereinafter with reference to the accompanying drawings. In these drawings.

DETAILED DESCRIPTION OF THE PREFERRED EMBODIMENTS

Figure 1:
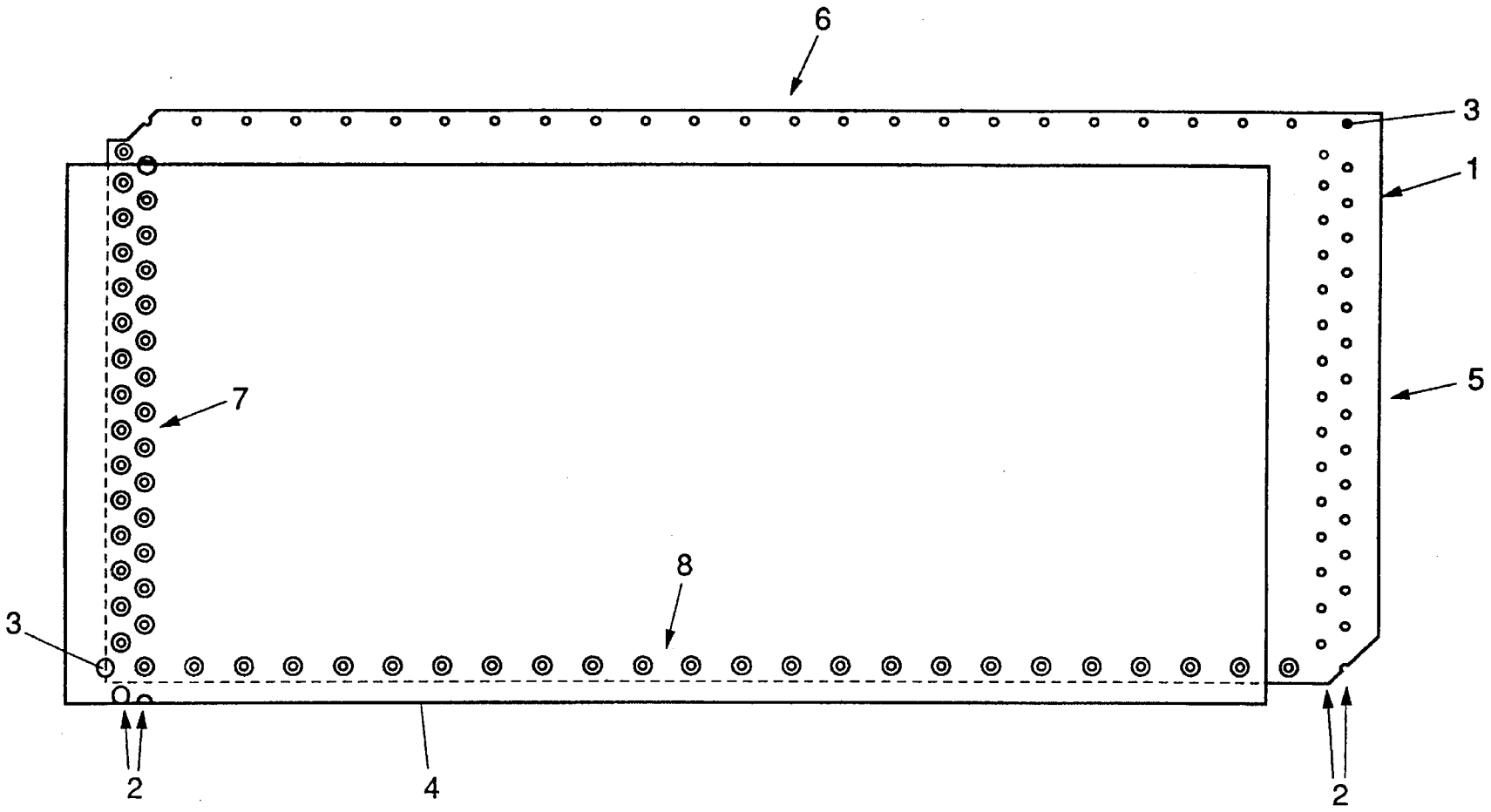
FIG. 1 schematically shows a view of a wall sheet according to the invention.

FIG. 1 schematically shows an interior view of a wall sheet 1 according to the invention. The wall sheet 1 can be made of any suitable material, for instance stainless steel, zinc-coated steel or the like. A particularly suitable material is enamelled sheet steel. As is conventional, the wall sheet 1 is substantially rectangular and is usually curved in at least one direction in agreement with the dimensions and shape of the silo or tank to be built. Along the vertical and horizontal edges, the wall sheet is provided with one or more rows of bolt holes. In the example shown, two rows of bolt holes 2 have in each case been provided along the vertical edges, and a single row of bolt holes 3 has in each case been provided along the horizontal edges. Through the bolt holes, adjacent sheets overlapping each other in the area of the bolt holes can be connected to each other by means of screw bolts or the like.

The wall sheet or base sheet shown further comprises a lining layer 4. The lining layer 4 leaves free two connecting vertical and horizontal edge areas 5 and 6 respectively, provided with bolt holes, but covers the other two edge areas 7 and 8 of the wall sheets. At the location of the edge areas 7 and 8, the lining layer 4 extends beyond the edge of the actual wall sheet.

Moreover, already fitted in the bolt holes covered by the lining layer are the required bolts, extending outward, i.e. pointing away from the lining, so that it is not necessary to make openings in the lining layer.

To prevent rotation of the bolts when the nuts are being fixed during the mounting operation of the silo, carriage bolts can for instance be used, which cannot rotate in the bolt holes and may have a smooth, flat-rounded head, as is conventional for carriage bolts.

Consequently, a wall sheet according to the invention for a tank or silo is already provided with a lining and also with the required fastening means.

The lining may consist of a suitable, usually thermoplastic synthetic material, for instance polyethylene, polypropylene or fluoropolymer, if necessary further provided with a suitable fabric back or another support for effecting an optimum bond to the wall sheet. The choice of the lining material depends on the intended application of the silo or tank. The lining can be brought into the proper form by placing on or in a suitable mold, which may for instance be the wall sheet already formed, provided with the required bolts, a sheet of lining material in a manner such that two edge areas with bolt holes remain free, as shown in FIG. 1, while the two other edge areas with the bolt holes already provided with bolts are covered on the side of the bolt heads. Subsequently, the sheet of lining material is pressed onto the mold, if required with the addition of heat (thermoforming), so that the sheet of lining material adopts the proper form, including any moldings for bolt heads.

After cooling, the thus obtained sheet of lining material is subsequently attached to the wall sheets by means of a suitable bonding agent. For this purpose, the wall sheet may have been priorly subjected to a mechanical and/or chemical surface treatment. For instance, the wall sheet may have been roughened through sandblasting or the like.

Enamelled wall sheets can advantageously be used, because the enamel layer can be roughened without involving the danger of oxidation taking place after the treatment in question. After the formed lining sheet has been bonded, for instance through glueing, the silo wall sheet (or tank wall sheet) is ready for assembly, together with similar covered wall sheets, into a silo or tank.

Figure 2:
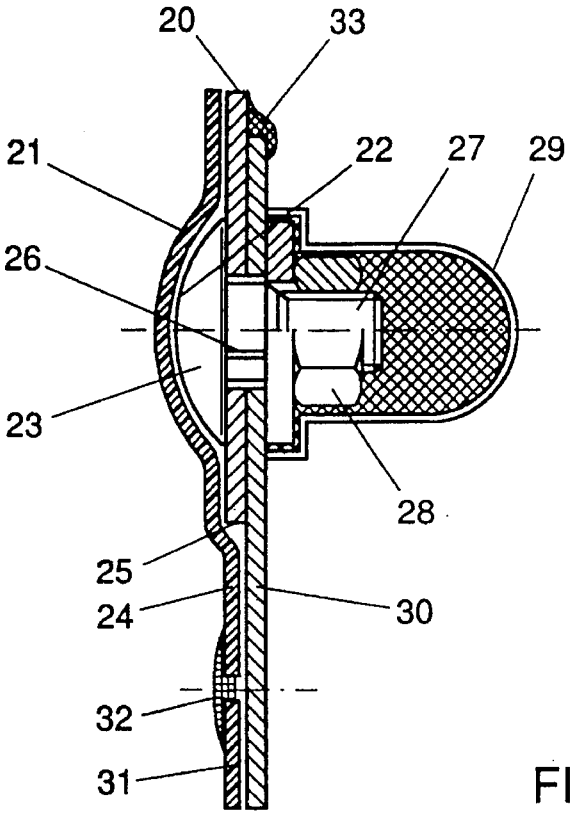
FIG. 2 schematically shows, in section, the overlap area of two connecting wall sheets according to the invention.

FIG. 2 shows a section across a fastening bolt in the overlap area of two wall sheets, screwed together, according to the invention. FIG. 2 may be a vertical as well as a horizontal section. A first wall sheet 20 is provided, on the inside, with a synthetic lining 21, which, in the example shown, is firmly attached to the wall sheet via a fabric layer 22 or another suitable intermediate layer and glue. Depending on the type of material and/or the requirements determined by the intended use of the silo, the lining may of course also be applied without an intermediate layer. The lining is provided over the bolt heads, such as 23, and extends by a strip 24 beyond the lower edge 25 of the wall sheet.

In this example, the bolt 27 is a carriage bolt and may for this purpose be provided with a shank having a key 26 formed thereon, or may have an angular or unround shape with the shape of the bolt holes adapted thereto.

By a threaded part, the bolt passes through a free bolt hole in a second wall sheet 30, lying on the outside of the first sheet 20. The two sheets are interconnected by means of the bolt 27 and a nut 28. The nut is covered with a plastic cap 29. Further, as is conventional, a washer is used in the example shown. The sheet 30 has a lining 31, which, however, leaves the top edge of the sheet 30 free, as is shown in FIG. 1 at 6. The lining 31 also leaves free a side edge zone, as shown in FIG. 1 at 5.

In mounted condition, the depending strip 24 of the lining 21 of the top sheet 20 extends to near or somewhat beyond the top edge of the lining 31 of the bottom sheet. After the wall sheets have been mounted, the edges of the linings, lying side by side or overlapping each other, are connected to each other by means of a thermal weld 32 or in any other suitable manner. For forming such thermal welds, equipment is available that can be handled and transported in a simple manner.

It is observed that in this example, the depending edge strip 24 has not been attached to the bottom sheet 30. This does not affect the strength of the lining, because the edge 24 is only relatively narrow. This also offers the possibility of taking up small dimensional variations.

Obviously, the same applies to the side strip of a lining extending over an adjacent wall sheet.

However, alternatively, the overlapping edge strips may be attached to the adjacent wall sheets, if so desired, for instance by means of a suitable bonding agent.

Figure 3:
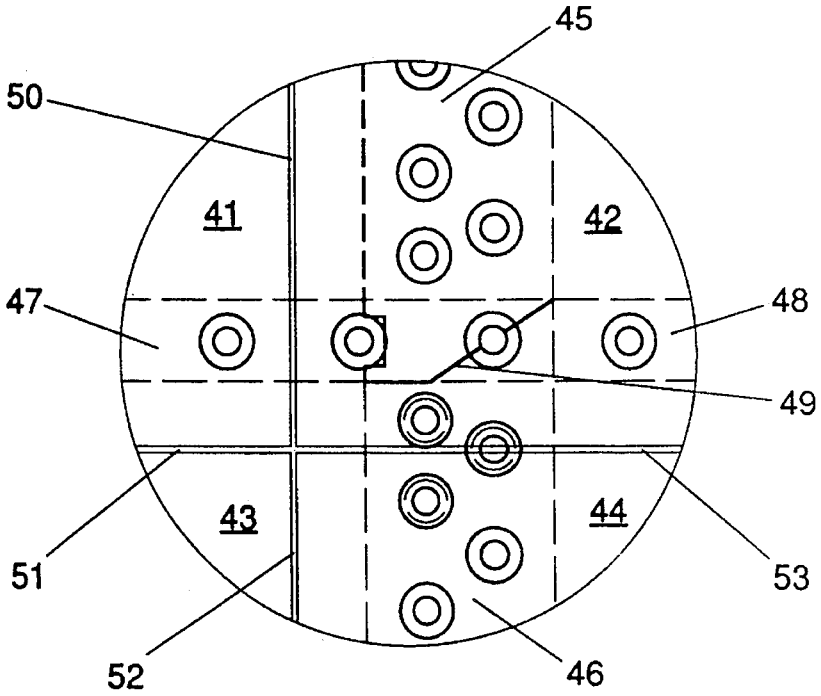
FIG. 3 schematically shows an overlap area or four connecting corner areas of mounted wall sheets according to the invention.

FIG. 3 schematically shows a wall section where the corner points of four wall sheets come together. The sheets are designated by 41, 42, 43 and 44. The sheets 41 and 42 have a vertical overlap zone 45, while the sheets 43 and 44 have an overlap zone 46 in line with the zone 45. Similarly, horizontal overlap zones 47 and 48 are present between the sheets 41 and 43, respectively 42 and 44.

To prevent too large a thickening up, the top-left corner and the bottom-right corner of each sheet have been removed, as is shown in FIG. 1. In mounted condition, the sheets abut against each other along the resulting oblique lines of cut, as is indicated at 49.

Due to the projecting edge strips, such as 24 (FIG. 2), the linings provided on the sheets abut against each other at a distance from the overlap zones 45, 46, 47, 48. The weld seams in question are indicated at 50–53.

FIG. 4 schematically shows another and most preferred manner of mounting a fastening member in an opening in a wall sheet. FIG. 4*a* shows, in section, a portion of a wall sheet 60 having an opening 61. FIG. 4*b* shows a bolt 62, pressed into the opening 61. The bolt 62 has a flat head 63 with a bevelled edge. Further, directly under the head, the bolt has a circumferentially knurled portion 64. The knurled portion has an outer diameter which is slightly greater than the diameter of the opening 61. The bolt has been pressed into the opening with the knurled portion cutting into the edge of the opening and thus secures the bolt against rotation. The bolt is also secured against movement in the longitudinal direction, because it tightly fits in the opening. Thus, the bolt cannot fall out of the opening or accidentally be pushed out of the opening during the construction of a silo. Tests have shown that even in the case of enamelled wall sheets it is possible to mount fastening bolts in this manner without damaging the enamel layer around the opening in any detrimental way. It is also possible to deform the wall sheet such that the head 63 of the bolt is at least largely countersunk into the sheet, as is shown in FIG. 4*b*. This involves the other side of the sheet material slightly bulging outward, as is shown at 65, which further enhances the contact between the part 64 and the sheet.

Figure 4B:
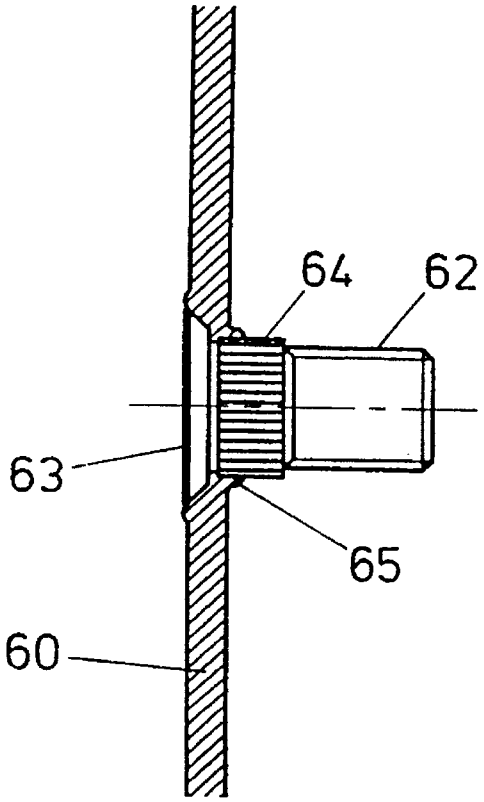
FIG. 4 schematically shows an example of a manner of fixing the wall sheets according to the invention.
Figure 4A:
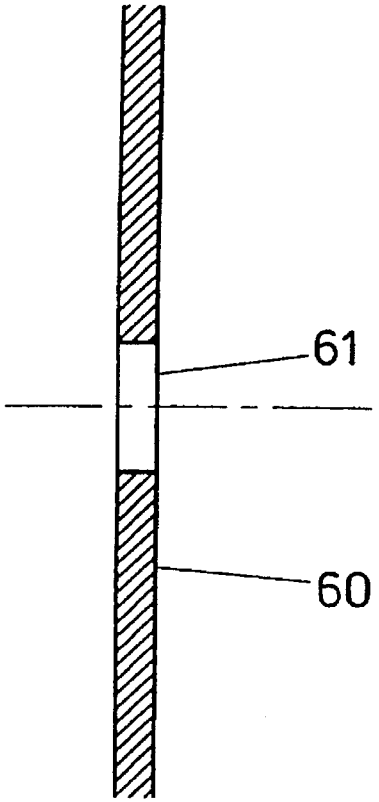
Figure 4D:
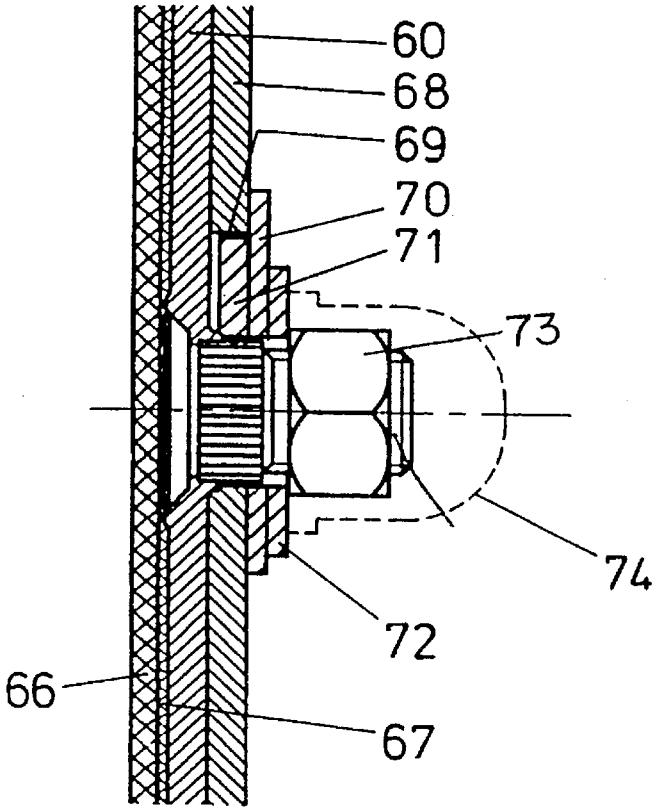
Figure 4C:
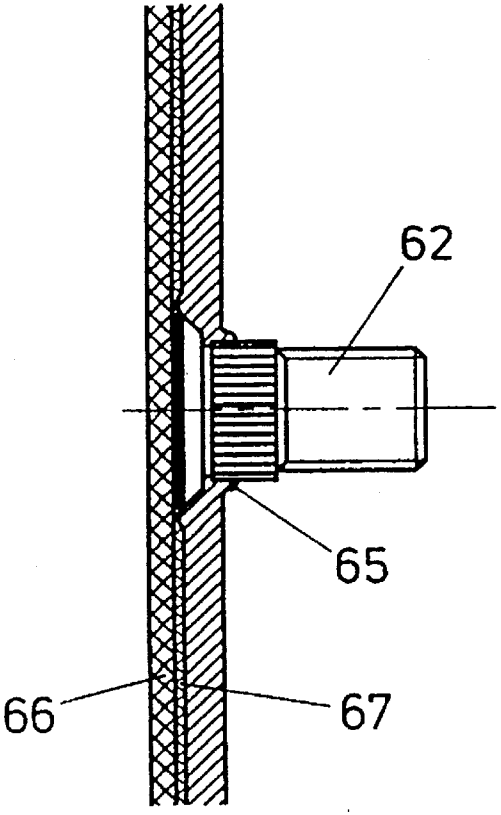

FIG. 4*c* shows the same portion of the wall sheet as FIGS. 4*a* and 4*b*, but now provided with a lining 66, attached to the sheet via a bonding layer 67, which may or may not be provided with a reinforcement. Finally, FIG. 4*d* shows a second wall sheet 68, attached to the wall sheet 60 by means of the bolt 62. In the example shown, the second wall sheet has slotted holes 69 in the edge zones not covered by the lining (compare the edge zones 5 and 6 in FIG. 1). The use of slotted holes in at least a number of wall sheets facilitates the assembly of a silo. The slotted hole 69 is also capable of receiving the bulge 65. The slotted hole is filled by means of a special washer 70, comprising a back 71 slipping into the slotted hole. Further, in the example shown, an additional thickening 72 has been provided on the outside of the washer, so that the nut 73 remains clear of the knurled portion 64 of the bolt. Over the nut there may be provided a cap 74.

The parts 70–72 of the washer may form one whole, but it is also possible to use two or three separate elements. Also, the part 70 could for instance be so thick that the part 72 can be dispensed with. Further, instead of a slotted hole, it is also possible to use a round hole having an enlarged diameter. Accordingly, the part 71 of the washer should have an adapted shape.

Further, a silo may be provided with one or more passage openings in the wall for supplying or discharging liquid. Also, one or more manholes may be provided. Such passage openings or manholes may have been incorporated into special passage elements mounted in openings in adapted wall sheets, in which case it is again possible to use priorly mounted and lining-covered fastening members in a similar manner as described hereinabove.

Figure 5:
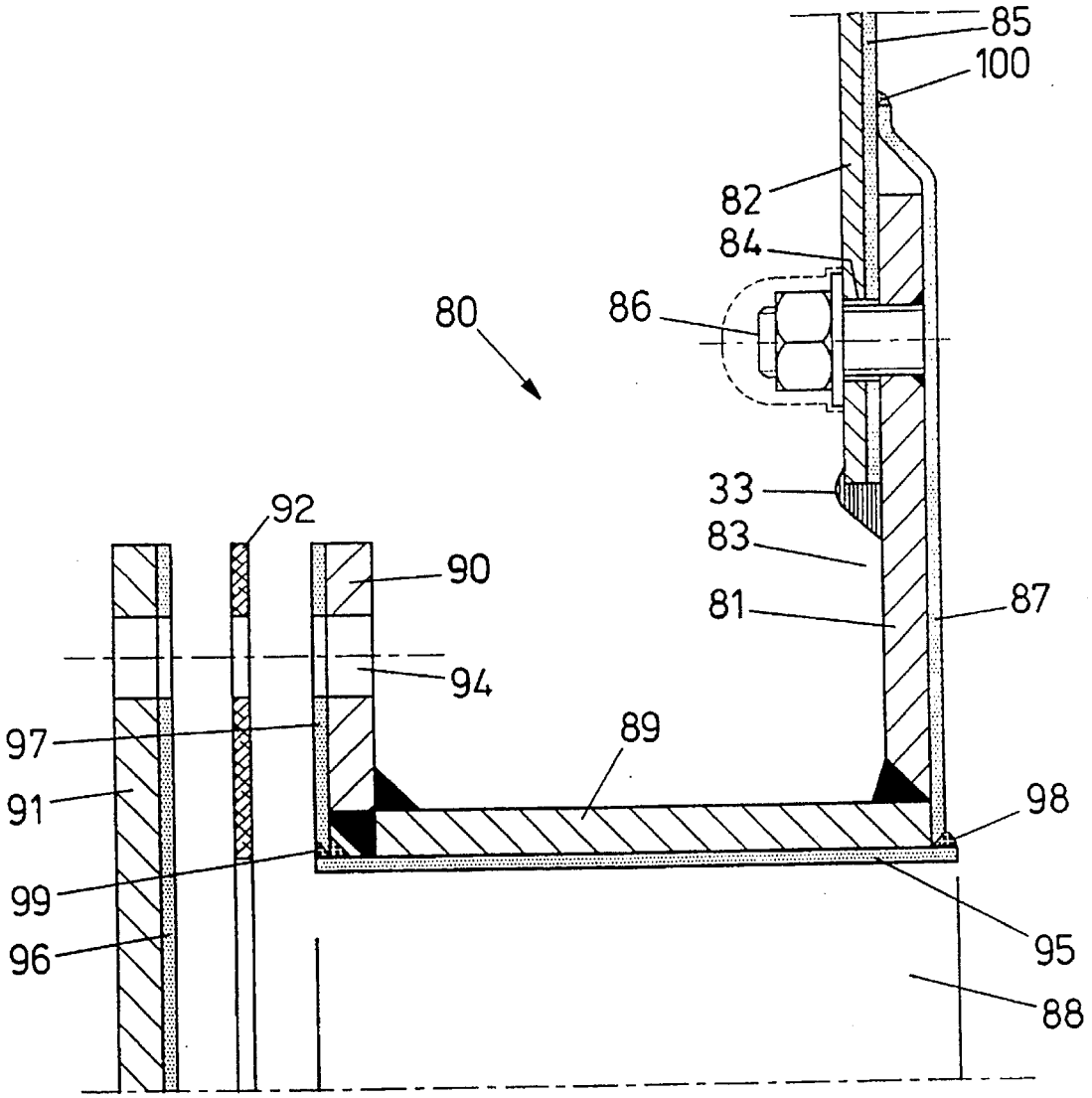
FIG. 5 schematically shows, in section, a portion of a passage element for use in a silo or tank according to the invention.

FIG. 5 schematically shows, in section, a portion of a passage element 80. The passage element 80, in mounted condition, has a vertical flange 81, mounted on a wall sheet 82 on the inside of a silo or tank. The wall sheet 82 is priorly provided with a suitable passage opening 83 and with bolt holes 84, provided around the opening. In this example, the lining 85 of the wall sheet extends to the edge of the opening and the bolt holes are provided in the lining 85 as well. However, if so desired, it is also possible to use an adapted lining sheet which leaves free a strip around the opening 83.

The opening 83 and the flange 81 have dimensions depending on the nature of the passage opening. A manhole requires a relatively large, often approximately rectangular passage opening, whereas a liquid passage opening is often relatively small and usually circular.

The flange 81 is provided with bolt holes wherein bolts 86 or the like are arranged in one of the above-described manners. In the example shown, stud bolts are used that are secured in the bolt holes by welding. Also, the bolt holes in the flange may further be provided with a screw thread. After all, the material of the flange may be thicker than that of the wall sheets, so that other fastening techniques can be used as well. Further, in mounted condition, the flange 81 comprises a lining 87 on the inward-facing surface thereof, which is preferably of the same material as the lining 85 and which may also be attached in the same manner.

The flange 81 is again provided with a passage opening 88, bounded by an outwardly extending tube branch 89. The tube branch 89 is provided, at the free end thereof, with a collar 90 on which a cover 91 can be mounted, in one of the manners known therefor, with or without the interposition of a gasket 92 of a suitable material. In the example shown, the collar 90, the cover 91 and the gasket 92 are provided with bolt holes 94.

The tube branch 89 and the cover 91 may both contact, on the inside thereof, the liquid contained in the silo. Consequently, the tube branch is internally provided with a layer of lining material 95, while the cover, on the inside thereof, is also provided with lining material 96. In the example shown, the collar 90 is also provided with lining material 97.

The parts of lining material of the flange, the tube branch and the collar are connected to each other through welding (or, optionally, glueing), as indicated at 98 and 99.

Further, the lining material 87 has a free edge extending beyond the circumferential edge of the flange 81, attached to the lining material on the inside of the silo wall through glueing and/or welding, as shown at 100.

It is observed that in the construction shown the passage element is fitted in a wall sheet already provided with a lining, which may or may not have been mounted in a silo wall already.

Of course, it would also be possible to manufacture special wall sheets which are provided with a passage element straight away while the lining material and, if desired, a layer of enamel may be provided afterwards.

It is observed that in view of the above, various modifications will readily occur to a skilled person. The invention may for instance also be used for wall sheets which are not rectangular or silos or tanks which are not round. Further, the bonding of the lining to the wall sheets could in some cases take place under pressure, possibly even at the same time when the lining is-pressed into shape. As sealing material between the wall sheets, cement can be used, as shown at 33 in FIGS. 2 and 5, but sealing tape or the like, whether or not in combination with cement, can be used as well.

Further, in principle, it is possible to provide the wall sheets, at the location of the bolt holes, with (rounded) nuts and to fit the bolts from the outside afterwards. However, this involves the danger that the bolts, when they are being tightened, pass through the nuts and damage the lining.

Other types of fastening means can be used as well.

These and similar modifications are understood to fall within the scope of the invention.

I claim:

1. A method of building up a silo or tank with a lining by means of pre-formed, substantially rectangular, wall sheets, connected to each other by means of screw connections for forming a complete silo wall, characterized in that wall sheets are used provided, along the edges thereof, with bolt holes, the bolt holes in zones located along at least two connecting edges being provided with fastening members secured against rotation, and the zones comprising said fastening members and the rest of each wall sheet being covered, on the inside thereof, by a layer of lining material bonded to the wall sheet, leaving free two other free edge zones provided with bolt holes, said layer of lining material extending by edge strips beyond the edges of the zones having bolt holes provided with fastening members, and that the wall sheets are fastened to each other by means of the fastening members and the bolt holes in a manner such that said edge strips of the layer of lining material of a wall sheet cover the free edge zones of two adjacent wall sheets, and that the adjacent edges of the layers of lining material of different wall sheets are sealingly bonded to each other.

2. A method according to claim 1, characterized in that parts of two diagonal opposite corners of said wall sheets, left free by the lining material, have been removed.

3. A method according to claim 1, characterized in that steel wall sheets enamelled on both sides are used.

4. A method according to claim 1, characterized in that the fastening means comprise carriage bolts.

5. A method according to claim 1, characterized in that the adjacent edges of the layers of lining material of different wall sheets are bonded together through welding.

6. A method according to claim 1, characterized in that as fastening means, bolts are used which are tightly pressed into the bolt holes.

7. A method according to claim 1, characterized in that at least a number of wall sheets are used whose free edge zones have holes of larger dimensions than the diameter of the fastening members.

8. A method according to claim 7, characterized in that the holes in the free edge zones are slotted holes.

9. A method according to claim 7, wherein washer elements are used, filling the holes in the free edge zones around fastening members passing through the holes in the free edge zones.

10. A method according to claim 1, characterized in that at least one of the wall sheets is provided with a closable passage element, also provided, on the inside thereof, with a layer of lining material.

11. A wall sheet for building up a silo or tank, comprising a pre-formed base sheet provided, along the circumference thereof, with rows of bolt holes, characterized in that on the inside of the silo to be built the wall sheet is provided with a layer of lining material, bonded to the base sheet, said layer of lining material leaving free the bolt holes along two connecting edge zones and covering the bolt holes along two other connecting zones, the covered bolt holes being provided with fastening means also covered by the layer of lining material and the layer of lining material, at the location of said other connecting zones, having free edge strips extending beyond the edges of the base sheet.

12. A wall sheet according to claim 11, characterized in that the fastening means covered by the layer of lining material are carriage bolts fitted in the bolt holes so as to be secured at least against rotation and whose heads are covered by the lining material.

13. A wall sheet according to claim 11, characterized in that the fastening means are bolts tightly pressed into the bolt holes.

14. A wall sheet according to claim 13, characterized in that the bolts have a flat head and a knurled portion lying between the flat head and the screw thread portion.

15. A wall sheet according to claim 11, characterized in that the base sheet is manufactured from enamelled steel.

16. A wall sheet according to claim 11, characterized in that as a lining material, a synthetic material is used.

17. A wall sheet according to claim 16, characterized in that the synthetic material is a weldable synthetic material.

18. A wall sheet according to claim 11, characterized in that a bonding layer is provided between the base sheet and the layer of lining material.

19. A wall sheet according to claim 18, characterized in that the bonding layer includes a reinforcement layer.

20. A silo or tank built up by means of wall sheets according to claim 11 wherein the wall sheets are manufactured according to a method which is characterized in that a pre-formed base sheet is provided with fastening means in the bolt holes in two connecting edge zones, that a layer of lining material is pressed into the desired shape by means of a mold, and that the thus formed layer of lining material is bonded to the relevant base sheet.

21. A silo or tank according to claim 20, characterized in that in at least one of the wall sheets an opening is provided wherein a closable passage element is mounted, said passage element, in mounted condition, having a flange abutting against the wall sheet and provided with bolt holes wherein fastening members are fitted, the flange being provided with lining material covering the bolt holes in the flange and having at least one edge strip extending beyond the circumferential edge of the flange, said edge strip being bonded to the lining material of the wall sheet.

22. A passage element for mounting in an opening in at least one of a wall sheet of a silo or tank wherein said passage element, in mounted condition, has a flange adapted to abut against the wall sheet and provided with bolt holes wherein fastening members are adapted to fit, the flange being provided with lining material covering the bolt holes in the flange and having at least one edge strip extending beyond the circumferential edge of the flange, said edge strip adapted to bond to the lining material of the wall sheet.

23. A silo or tank built up by means of wall sheets according to claim 11.

24. A silo or tank according to claim 23, characterized in that in at least one of the wall sheets an opening is provided wherein a closable passage element is mounted, said passage element, in mounted condition, having a flange abutting against the wall sheet and provided with bolt holes wherein fastening members are fitted, the flange being provided with lining material covering the bolt holes in the flange and having at least one edge strip extending beyond the circumferential edge of the flange, said edge strip being bonded to the lining material of the wall sheet.

25. A passage element for mounting in an opening in at least one of a wall sheet of a silo or tank wherein said passage element, in mounted condition, has a flange adapted to abut against the wall sheet and provided with bolt holes wherein fastening members are adapted to fit, the flange being provided with lining material covering the bolt holes in the flange and having at least one edge strip extending beyond the circumferential edge of the flange, said edge strip adapted to bond to the lining material of the wall sheet.

* * * * *